US006517161B2

(12) United States Patent
Lo

(10) Patent No.: US 6,517,161 B2
(45) Date of Patent: Feb. 11, 2003

(54) LOUNGE CHAIR WITH ELASTIC SUPPORT DEVICE

(76) Inventor: Albert Chong-Jen Lo, 3023, Windy Knoll Ct., Rockville, MD (US) 20850

( * ) Notice: Subject to any disclaimer, the term of this patent is extended or adjusted under 35 U.S.C. 154(b) by 0 days.

(21) Appl. No.: 09/836,248

(22) Filed: Apr. 18, 2001

(65) Prior Publication Data

US 2002/0153757 A1 Oct. 24, 2002

(51) Int. Cl.[7] ..... A47C 7/00
(52) U.S. Cl. ..... 297/440.11; 297/452.13
(58) Field of Search ..... 297/440.1, 440.11, 297/448.1, 445.1, 452.11, 452.13, 440.23, 452.12, 440.2, 440.22, 449.1, 452.18, 452.19, 450.1, 452.63, 452.64

(56) References Cited

U.S. PATENT DOCUMENTS 3,228,724 A * 1/1966 Resar ..... 297/440.11 X
4,234,226 A * 11/1980 Colby ..... 297/45 X
D366,572 S * 1/1996 Hess ..... D6/372
5,507,563 A * 4/1996 Arthur, Jr. ..... 297/440.23
5,911,478 A * 6/1999 Goodman ..... 297/440.11
D426,971 S * 6/2000 Tseng ..... D6/375
D429,077 S * 8/2000 Lin ..... D6/360
D449,176 S * 10/2001 Schulte et al. ..... D6/375

* cited by examiner

*Primary Examiner*—Peter M. Cuomo
*Assistant Examiner*—Stephen Vu
(74) *Attorney, Agent, or Firm*—Bacon & Thomas, Esq.

(57) ABSTRACT

A chaise longue includes two foot frames of an inverted U shape, a seat and backrest composed of two side rods and a soft surface sheet fixed between the two side rods, which have respectively a downwardly sloped front portion, a nearly horizontal intermediate portion and an upwardly sloped portion, and a support device pivotally fixed with rear sides of upper ends of the two side rods. The support device consists of two support rods and a support base connected pivotally with inner ends of the two support rods. The support rods have their outer ends respectively pivotally connected to the two side rods so that the two support rods may be expanded to form a line with the support base between the two side rods to expand the soft surface sheet.

3 Claims, 6 Drawing Sheets

LOUNGE CHAIR WITH ELASTIC SUPPORT DEVICE

BACKGROUND OF THE INVENTION

This invention relates to a chaise longue or lounge, particularly to one having a seat and backrest made of a soft sheet able to be folded after the chaise longue is assembled together so that the chaise longue may be collapsed for transporting, thereby reducing its transporting cost.

Conventional chaise longues are generally classified into two kinds, one stationary and the other collapsible. A stationary chaise longue disclosed in Taiwan Utility Model Patent Publication No. 371867 (as attached appendix) titled "Chaise longue" dated Oct. 11, 1999 has a high backrest for a user to have the back completely lie thereon comfortably, but the size of the whole chaise longue is very large so that one container cannot carry a large number of them for transportation, resulting in a high transportation cost, a disadvantage to both makers and consumers.

Conventional collapsible chaise longues have two foot frames provided with feet to stand on the ground, and rods at two side of a seat to become a stationary chaise longue. The seat may be made separable from the foot frames, having a smaller size than the stationary chaise longues, allowing the transporting cost to be less than the stationary chaise longues. The seat and backrest are made of a soft sheet (such as net-style cloth made of PVC), and the upper end of the seat and backrest are supported by an inverted U-shaped rod fixed on a rear side of the side rods at the two sides of the upper end in order to prevent the portion of the soft seat and backrest sheet from recessing due to the weight of the head of a user. The inverted U-shaped rod expands the two side rods so as to expand the soft seat and backrest sheet outwardly to support the head of a user. The length of the inverted U-shaped rod is longer than the distance between the two side rods, so the two side rods have to be expanded in advance to combine the inserted U-shaped rod and the two side rods. When packaging the conventional collapsible chaise longue, the seat and backrest remain stationary, with the foot frame collapsible. The package may be a little large, thereby resulting in expensive transportation cost.

SUMMARY OF THE INVENTION

The objective of the invention is to provide a chaise longue having an expanding device for a soft seat and backrest sheet so as to collapse the chaise longue in order to reduce its size when collapsed, and reducing its transportation cost.

BRIEF DESCRIPTION OF DRAWINGS

This invention will be better understood by referring to the drawings, wherein.

DETAILED DESCRIPTION OF THE PREFERRED EMBODIMENT

Figure 1:
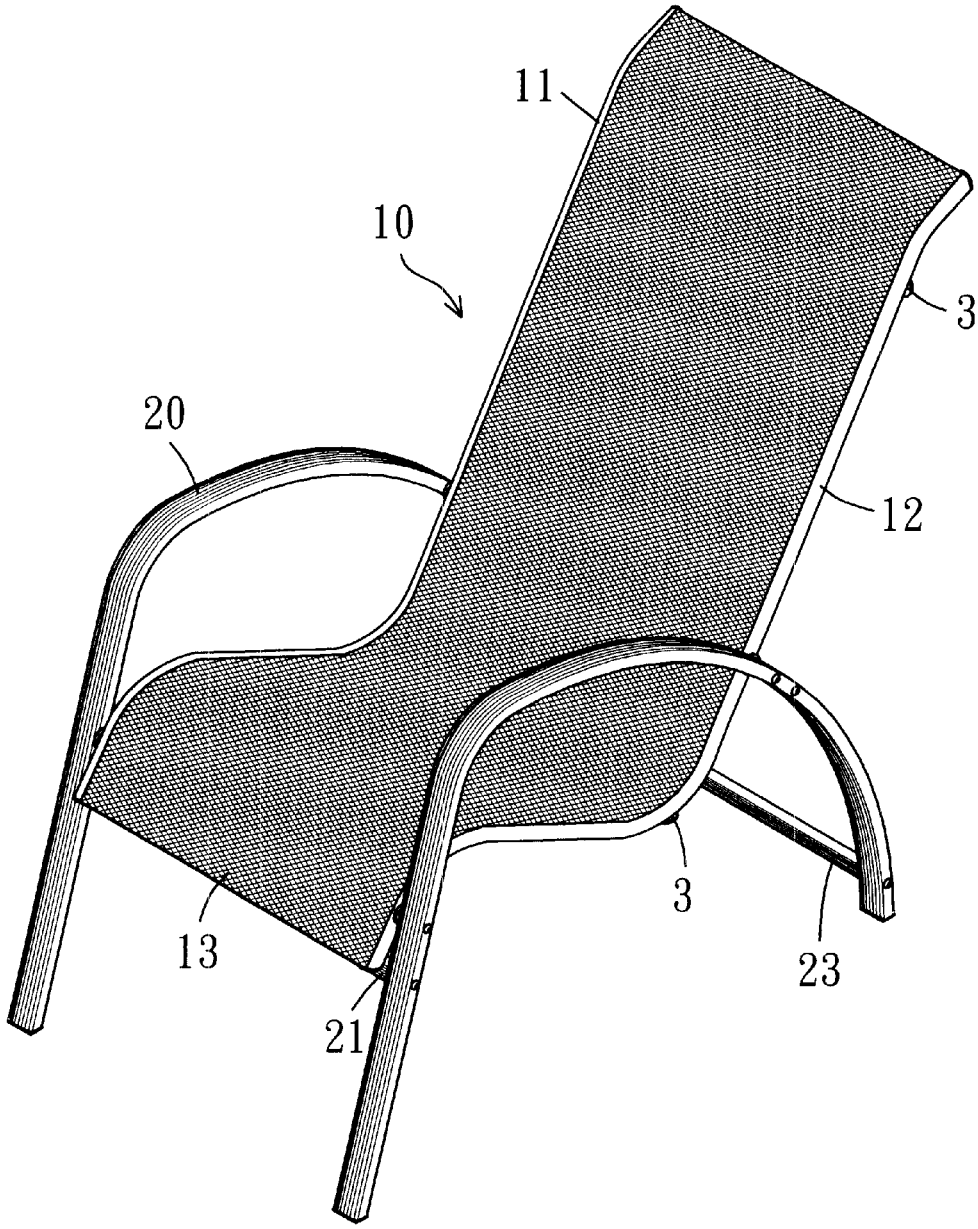
FIG. 1 is a perspective view of a chaise longue of the present invention.
Figure 2:
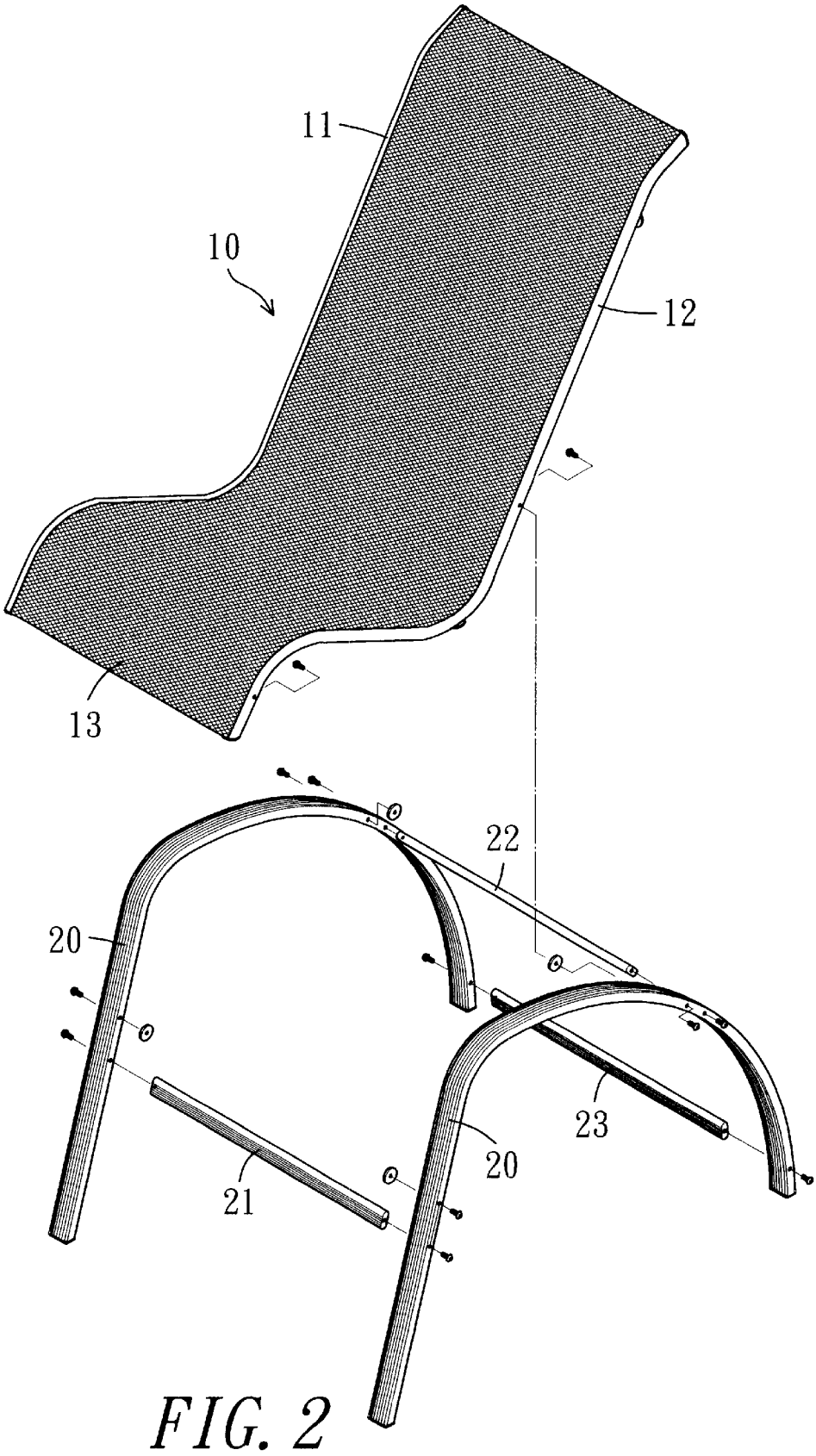
FIG. 2 is an exploded perspective view of the chaise longue of the present invention.

A preferred embodiment of a chaise longue of the present invention, as shown in FIGS. 1 and 2, includes a seat and backrest 10 and two foot frames 20 assembled together.

The two foot frames 20 are arch-shaped, each respectively having two ends standing on the ground. Three lateral rods 21, 22, and 23 are respectively combined firmly between a front portion, an intermediate portion and a rear portion by screws means through the walls of the two foot frames 20. Thus the two foot frames are collapsible to reduce their space in storing and transporting.

Figure 3:
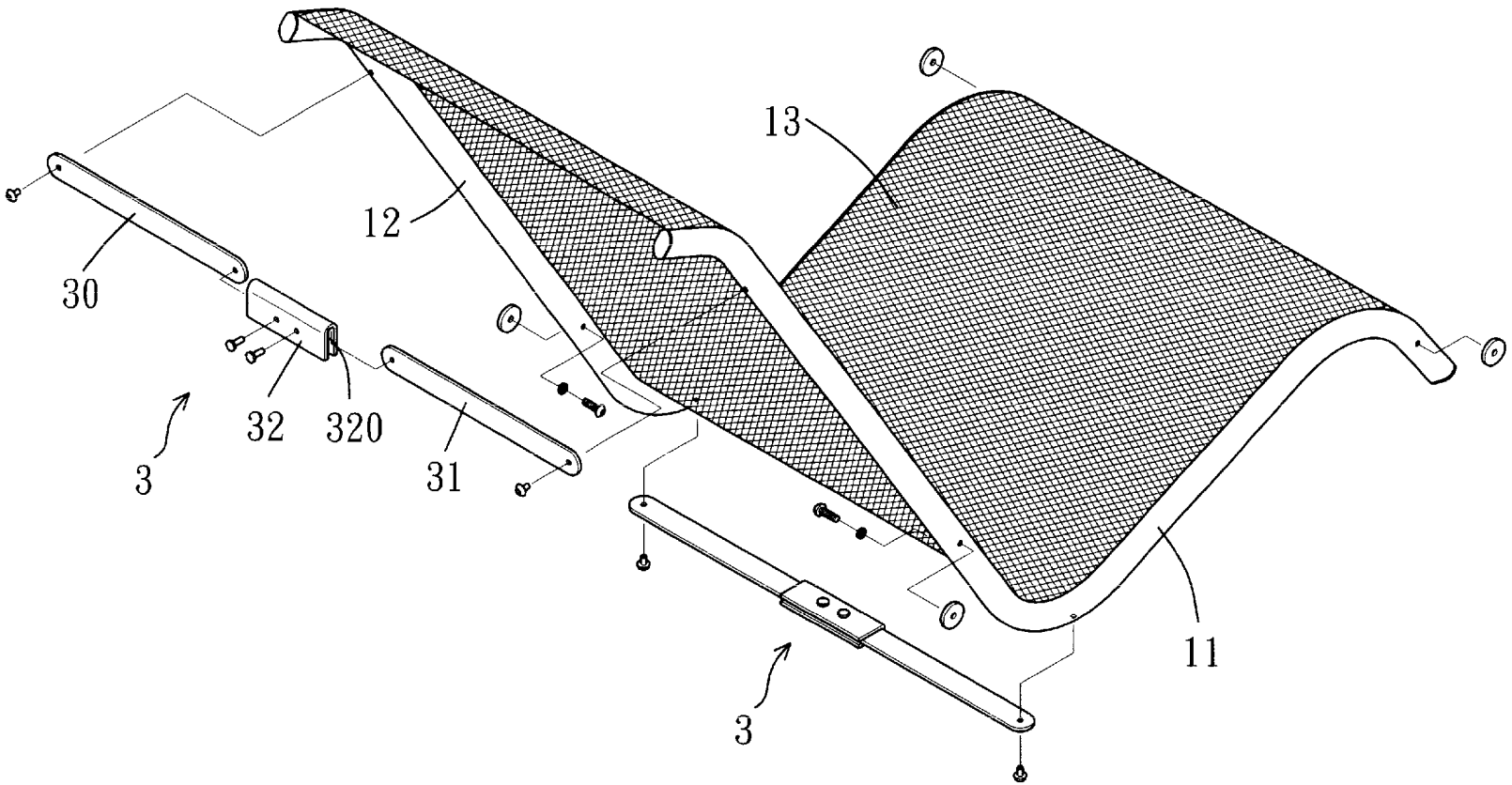
FIG. 3 is an exploded perspective view of a support device and a foot frame of the present invention.
Figure 4:
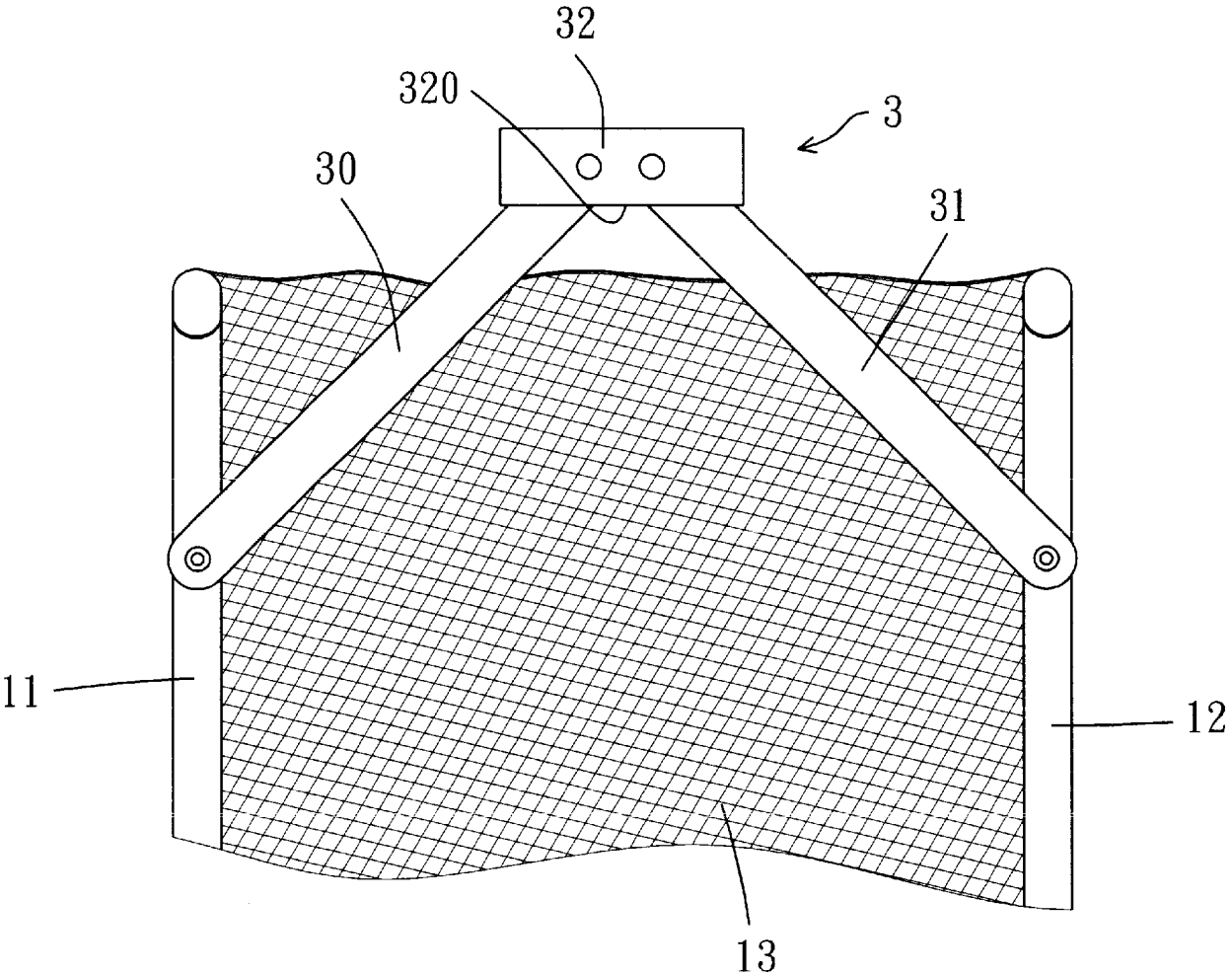
FIG. 4 is a rear view of the support device combined with the foot frame of the present invention.
Figure 5:
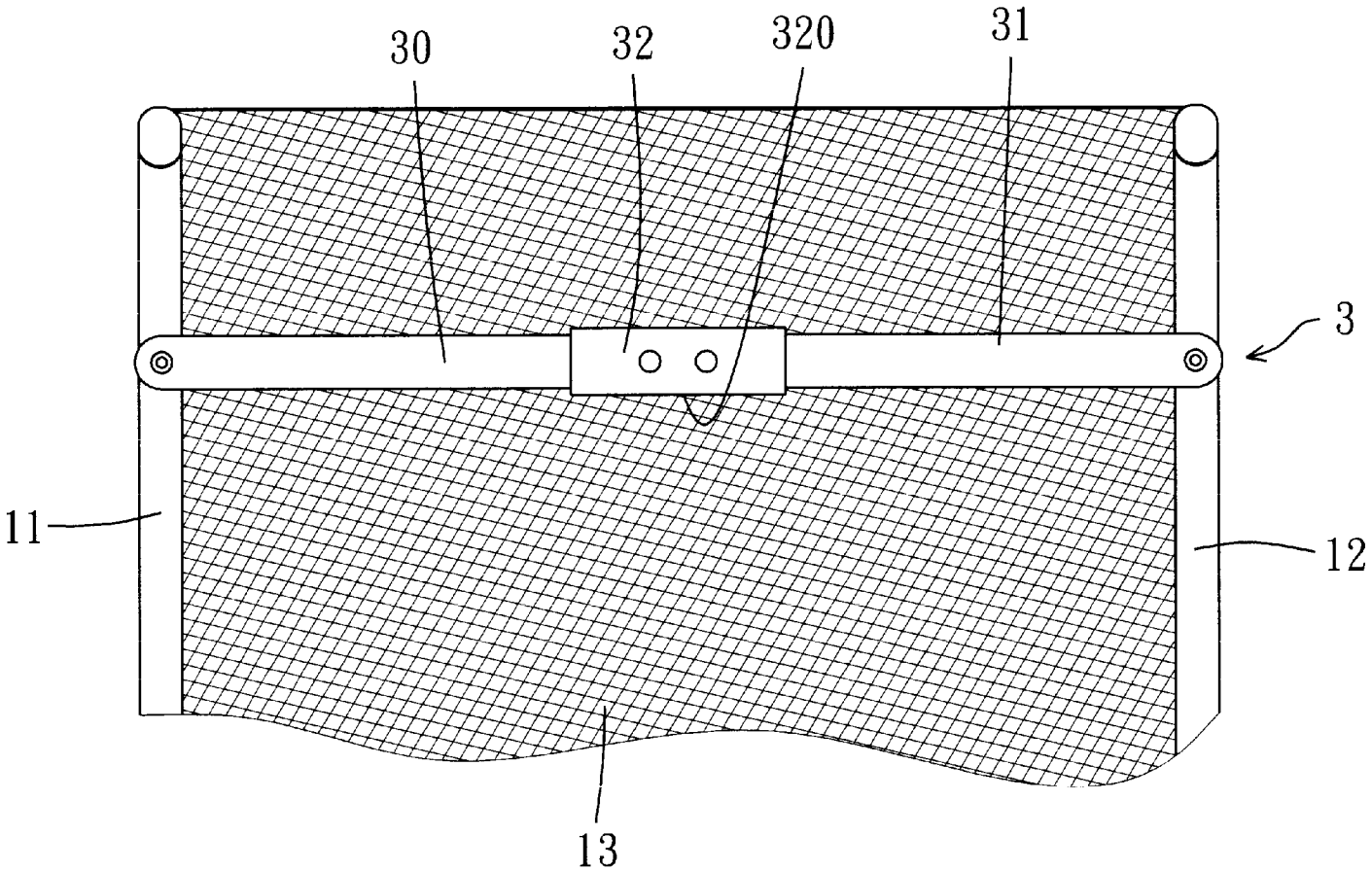
FIG. 5 is a rear view of the support device expanded for using the chaise longue of the present invention: and, FIG. 6 is an upper view of the support device expanded of the present invention.

The seat and backrest 10 consist of two side rods 11 and 12 each respectively having a downwardly sloped front portion, a nearly horizontal intermediate portion used for a seat and an upwardly sloped portion used for a backrest, and a soft surface sheet 13 made of a soft material such as a plastic net cloth 13 kept between the two side rods 11 and 12. The two side rods 11 and 12 are securely screwed with the two foot frames 20 so as to provide the seat and backrest 13 to be stable for a user to sit or lie on. Further, a support device 3 is fixed between the two side rods 11 and 12, as shown in FIG. 3, located behind the intermediate portions of the two side rods 11 and 12 to be poised to expand outwardly as shown in FIGS. 4 and 5. The support device 3 can also be positioned between the lower ends of the two side rods 11 and 12, having two support rods 30 and 31 connected pivotally with a support base 32, which is an inverted U-shaped and has an opening 320 facing downwardly for inner ends of the support rods 30 and 31 and pivotally connected with the support base 32. Therefore, when the two support rods 30 and 31 are expanded to the largest angle, they are stopped by the upper side of the support base 32, as shown in FIG. 5. And the combined length of the two support rods 30, 31 and the support base in the expanded position is a little longer than the distance between the two side rods 11 and 12 expanded so that the support base 32 may be pushed downwardly to expand the two support rods 30 and 31 to the largest angle after the outer ends of the two support rods 30 and 31 are pivotally connected to the two side rods 11 and 12. Thus, the two side rods 11 and 12 are kept in the expanded position to force the soft surface sheet 13 to be extended outwardly, preventing the soft surface sheet 13 from recessing when the head of a user rests on the top of the soft surface sheet 13.

Figure 6:
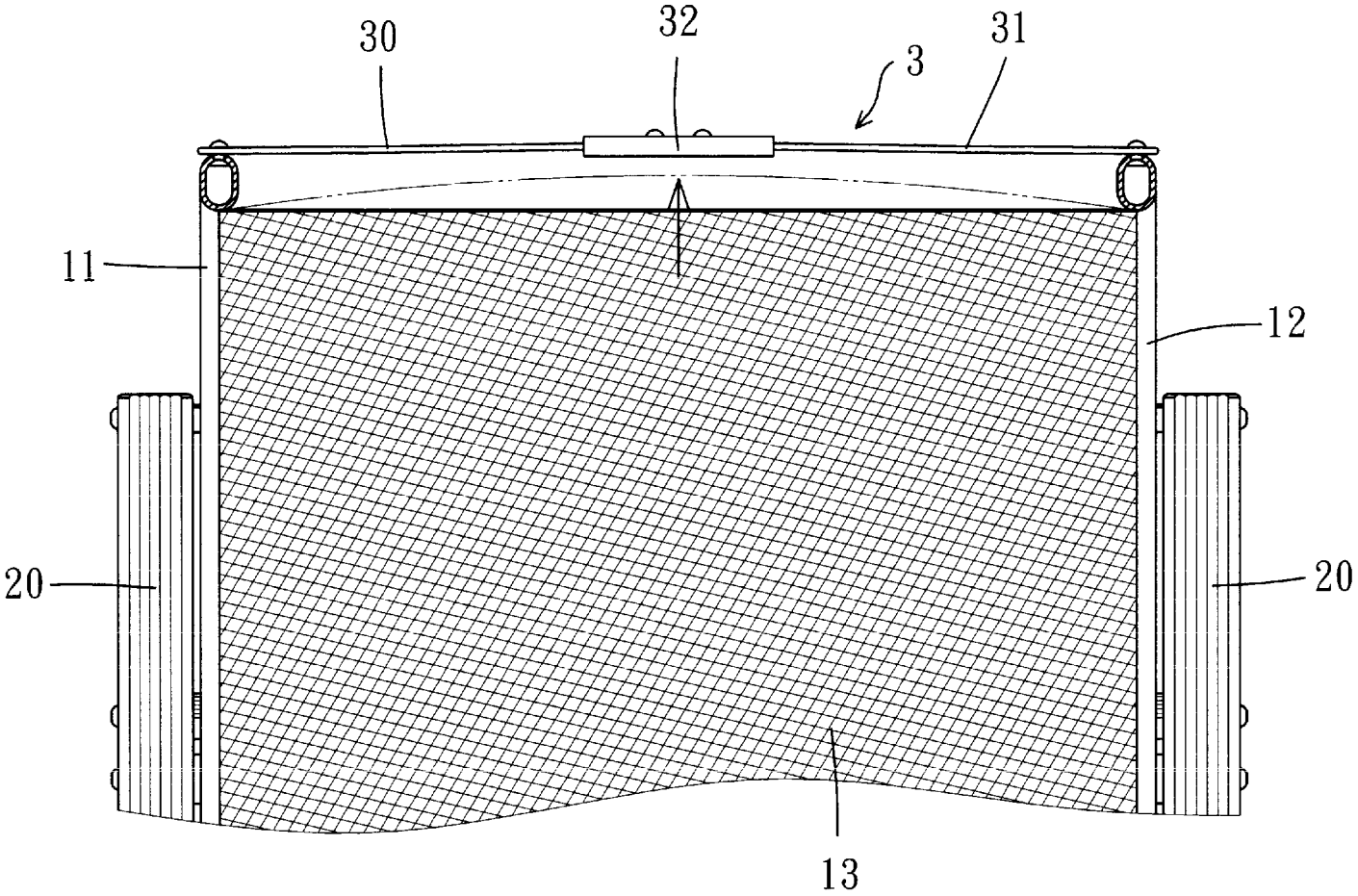

On the other hand, when the chaise longue in the invention is to be packaged for transportation, the support device 3 can permit the two support rods 30 and 31 to collapse the two side rods 11 and 12 inwardly so as to reduce the dimensions of the chaise longue for transportation. In addition, the two support rods 30 and 31 and the support base 32 in the expanded position have a combined length a little longer than the distance between the two side rods 11 and 12, so that the support device 3 may have its intermediate portion bend a little rearwardly as shown in FIG. 6, in addition to extending the soft surface sheet 13 between the two side rods 11 and 12. There is a certain gap between the soft surface sheet 13 and the support device 3, preventing the head or the buttock of a user from contacting with the support device 3.

As can be understood from the above description, the expanding structure of the soft seat and backrest of the chaise longue of the invention effectively reduces the dimensions of the whole chaise longue when collapsed and accordingly reducing its transportation cost. Besides, the support device 3 does not need to be expanded when the chaise longue is not in use, thereby improving another drawback of the conventional chaise longue, i.e. the soft surface sheet is always extended, thus reducing its elasticity gradually lost.

While the preferred embodiment of the invention has been described above, it will be recognized and understood that various modifications may be made therein and the appended claims are intended to cover all such modifications that may fall within the spirit and scope of the invention.

I claim:

1. A chaise lounge comprising:

a seat, a backrest, two foot frames, a plurality of lateral rods fixed between said two foot frames at a front portion, an intermediate portion and a rear portion, wherein said seat and said backrest comprises two side rods having a downwardly sloped front portion, an intermediate portion for a seat and an upwardly sloping portion for a backrest, and a soft surface sheet positioned between said two side rods; and a support device pivotally fixed between said two side rods and poised to expand said two side rods outwardly, said support device comprising two flat-shaped support rods and a support base connected pivotally to inner ends of said two support rods, said support base having an inverted U-shape with an opening facing downwardly, said support rods having inner ends pivotally connected to said support base and outer ends pivotally connected respectively to said two side rods, said two support rods and said support base including a combined length that is a little longer than the distance between said two side rods such that said two support rods can be expanded to form a line relative to said support base, and said support device providing elastic support for said side rods.

2. The chaise lounge as claimed in claim 1, wherein said support device is fixed to said two side rods.

3. The chaise lounge as claimed in claim 1, wherein said support device is fixed to lower ends of said two side rods.

* * * * *